United States Patent [19]

Jentzsch et al.

[11] Patent Number: 4,669,382

[45] Date of Patent: Jun. 2, 1987

[54] INK DOSAGE ADJUSTING DEVICE FOR INK ZONE SUPPLY IN A PRINTING MACHINE

[75] Inventors: Arndt Jentzsch, Coswig; Hans Johne, Radebeul; Wolfgang Müller, Coswig; Reiner Waurig, Radebeul; Horst Sachers, Coswig, all of German Democratic Rep.

[73] Assignee: Veb Kombinat Polygraph "Werner Lamberz", Leipzig, German Democratic Rep.

[21] Appl. No.: 836,645

[22] Filed: Mar. 5, 1986

Related U.S. Application Data

[63] Continuation-in-part of Ser. No. 625,117, Jun. 27, 1984, abandoned.

[30] Foreign Application Priority Data

Jun. 27, 1983 [DD] German Democratic Rep. ..... 2524036

[51] Int. Cl.[4] ..... B41F 31/04

[52] U.S. Cl. ..... 101/365

[58] Field of Search ..... 101/365, 350, 157, 169, 101/363, 148

[56] References Cited

U.S. PATENT DOCUMENTS

| | | | |
|---|---|---|---|
| 3,727,550 | 4/1973 | Easoz et al. | 101/365 |
| 3,747,524 | 7/1973 | Crum | 101/365 |
| 4,325,303 | 4/1982 | Rees | 101/365 |

FOREIGN PATENT DOCUMENTS

| | | | |
|---|---|---|---|
| 3049289 | 11/1981 | Fed. Rep. of Germany | 101/365 |
| 2087000 | 5/1982 | United Kingdom | 101/365 |

*Primary Examiner*—J. Reed Fisher

*Attorney, Agent, or Firm*—Michael J. Striker

[57] ABSTRACT

In the ink dosage adjusting device comprising at least one motor-driven ink zone adjusting screw for adjusting the position of the doctor blade relative to the doctor roller wear of the blade is compensated for by an additional adjusting device without an electrical readjustment of an electrical measure value receiver. The additional adjusting device includes a rotatable sleeve through which the ink zone adjusting screw extends.

6 Claims, 3 Drawing Figures

FIG. 2
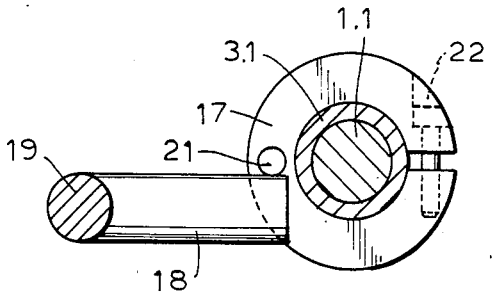
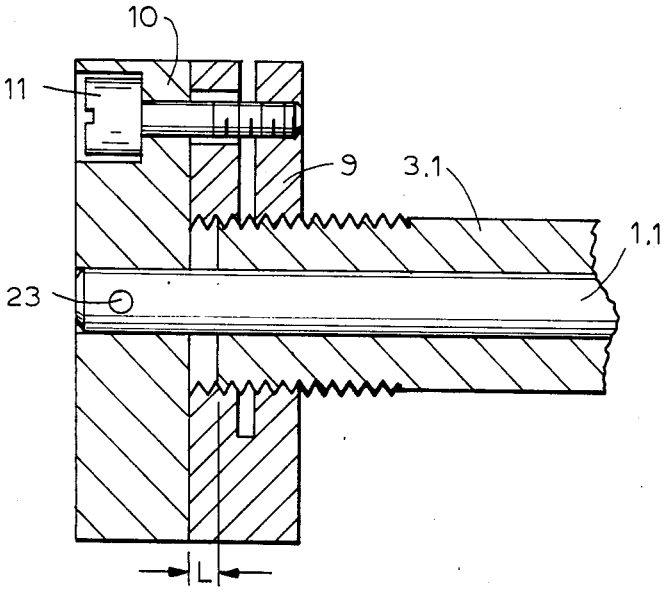
FIG. 3

INK DOSAGE ADJUSTING DEVICE FOR INK ZONE SUPPLY IN A PRINTING MACHINE

CROSS-REFERENCE TO RELATED APPLICATION

The present application is a continuation-in-part of patent application Ser. No. 625,117 filed June 27, 1984, now abandoned.

BACKGROUND OF THE INVENTION

The present invention relates to printing machines general, and more particularly to an ink dosage system therefor. Even more particularly, the invention pertains to an adjustment device for adjusting ink gaps in ink zones formed between the doctor blade and the doctor roller in the printing machine, especially for the rotary printing machine with a divided or undivided doctor blade.

One of adjustment devices of the type under discussion has been disclosed in German patent publication DD-PS 139,114. The disclosed adjustment device for adjusting the position of the ink blade relative to the doctor roller in the printing machine includes a motor connected to a special gear train which drives the ink zone adjusting screw for adjusting the position of the doctor blade. A potentiometer and an indicator serve in the known device for measuring and indicating respective positions of the ink zone adjusting screw. The disadvantage of this otherwise satisfactory adjustment device resides in that in the case of wearing off the doctor blade, the adjusted zero or initial position of the doctor blade, corresponding to a minimal distance between the doctor blade and the doctor roller is drifted under mechanical loads to which the doctor blade is subjected. However, without an electrical readjustment of the potentiometer in respect to the ink zone-adjusting screw it was impossible or extremely time-consuming to adjust the doctor roller, and the adjustment of the doctor blade according to real working conditions was almost impossible also.

SUMMARY OF THE INVENTION

It is an object of the present invention to provide a improved ink zone dosage adjustment device.

It is another object of the invention to provide an adjustment device in which maintenance or service time during the operation would be minimized.

These and other objects of the present invention are attained by an ink dosage adjusting device in a printing machine to adjust a position of a dosing doctor blade relative to a doctor roller to thereby adjust an ink gap therebetween, comprising at least one ink zone adjusting screw operatively connected to said dosing doctor blade to move the latter to and from said doctor roller, motor-driven driving means for driving said ink zone adjusting screw; a measure value receiver operatively connected to said screw for receiving an adjustment value; first adjusting means for adjusting the position of said screw and thus said ink gap without affecting the adjustment by said measure value receiver; and additional adjusting means arranged on said ink zone adjusting screw for compensating for wear of said dosing doctor blade.

The additional adjusting means may include a hollow sleeve connected to said screw.

The basic adjusting means may include a stop member longitudinally adjustably positioned on said sleeve.

The ink zone adjusting screw may extend through said sleeve.

The sleeve may carry a pinion, said driving means including a gear which is in mesh with the pinion.

The adjustment value receiver may carry another gear which is also in mesh with said pinion.

The device may further include a housing, said first adjusting means, said gears, said motor, said receiver and said stop member being positioned in said housing, said sleeve having an end extended outwardly of said housing.

The additional adjusting means may further include a positioning ring secured to said screw at its end, and a clamping ring mounted on the end of said sleeve and releasably connected to said positioning ring.

Therefore wear of the doctor blade is compensated for without an electrical readjustment of the measure value receiver, which can be a potentiometer as in the known arrangements.

The specific advantage of the present invention resides in a very simple manner of operating the adjusting device because the adjustment of the ink gap is carried out without any additional assembling or disassembling of the device which is very important if a multiple adjustment of the ink gap is required.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a cross-sectional view taken on line II—II of FIG. 1; and

FIG. 3 is a detail III of FIG. 1, on enlarged scale.

DETAILED DESCRIPTION OF THE PREFERRED EMBODIMENT

Figure 1:
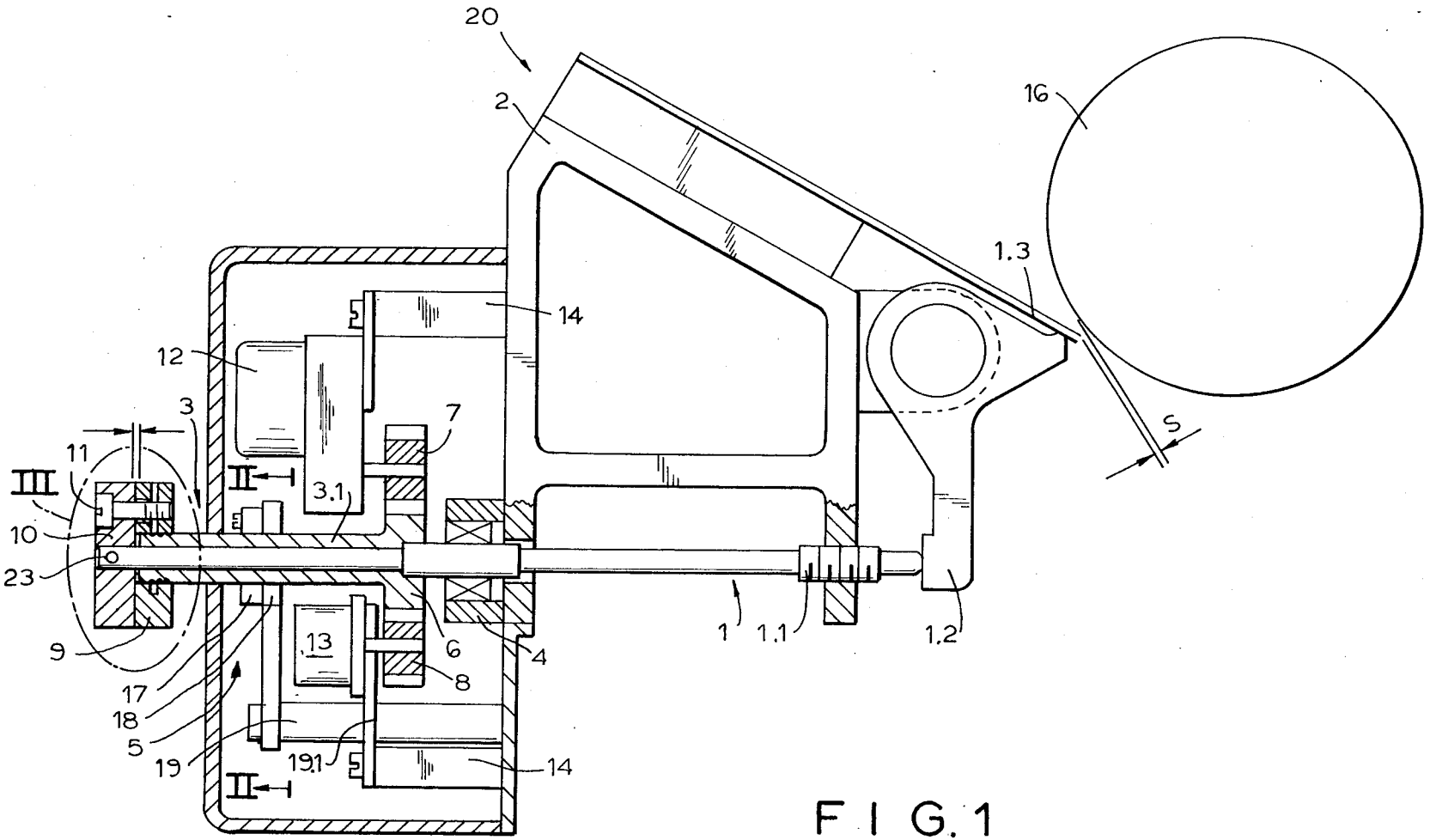
FIG. 1 is a schematical cross-sectional view through an ink trough and illustrating an additional adjusting device according to the invention.

Referring now to the drawings in detail, reference numeral 2 denotes an ink trough housing, reference numeral 16 designates a doctor roller and reference character 1.3 identifies a doctor blade or dosing member. The ink trough 20, ink roller 16 and doctor blade 1.3 can be of any known construction normally used in the printing machine of the type under consideration. The ink zone dosage adjustment device inserted in the known fashion in the ink trough includes an adjustment translating member 1 comprised of an adjustment lever 1.2 and an ink zone adjusting screw 1.1, of which the adjustment lever 1.2 is rigidly connected to the dosing member or blade 1.3; these elements have been known in the field of the invention and are disclosed, for example in U.S. Pat. No. 4,213,390, the entire disclosure of which is incorporated herein by reference. The ink zone adjusting screw 1.1 is rotatable in the additional adjustment device designated in toto by reference character 3. The additional adjustment device 3 includes an elongated sleeve 3.1 terminated at one end thereof with a gear 6 and a bearing 4. Adjustment device 3 is mounted in the ink trough housing 2 by means of an outer thread provided on the sleeve 3.1 and an inner thread formed in a clamping ring 9 of the additional adjustment device 3. As shown in FIG. 3 the additional adjustment device also includes the clamping ring 9 threaded on sleeve 3.1 and a positioning ring 10 connected to ring 9 by a clamping screw 11. An adjustable stop member 5 is secured to the elongated sleeve 3.1. Ink zone adjusting screw 1.1 extends through sleeve 3.1. The gear 6 of the sleeve 3.1 is in mesh with a motor pinion 7 connected to the output shaft of a motor 12 through a known gear train. On the other hand, gear 6 of sleeve 3.1 is in mesh with a gear 8 coupled to a measured value receiver 8 which may be the above discussed potentiometer or any other suitable adjustment value receiver. The sleeve 3.1 has at the accessible side or end thereof an outer thread on which the clamping ring 9 formed as a slotted and threaded ring is arranged. The positioning ring 10 is secured to the ink zone adjusting screw 1.1 by a pin 23 also at the accessible end of screw 1.1. Positioning ring 10 carries the clamping screw 11 which is threaded into the clamping ring 9 and thereby is clamped with this clamping ring when the positioning ring 10 is tightened up, so that the ink zone adjusting screw 1.1 and sleeve 3.1 are united into a single adjustment unit. Motor 12 and measuring value receiver 13 are fastened to the ink trough housing 2 by bolts 14 and plates 14.1.

Immediately at the front edge of dosing member 1.3 is positioned the doctor roller 16 the outer circumference of which forms with the dosing member 1.3 an ink gap S.

The adjustment of the position of the ink dosing member 1.3 relative to the doctor roller 16 in accordance with a required ink film profile results from the operation of motor 12 which, via the motor pinion 7, gear 6, sleeve 3.1, clamping ring 9 and positioning ring 10 drives the adjustment translating member 1. The displacement is generated by the thread on the ink zone adjusting screw 1.1 in connection with the counter thread in the ink trough housing 2.

The corresponding position of the ink adjusting screw 1 is measured with the aid of the measuring value receiver 13 and is indicated on a suitable known indicator positioned on the control desk in the known fashion.

The width of ink gap S=O serves as an initial point, which corresponds to a null or neutral position of the measured value-receiver 13 and of the stop member 5.

As clearly seen from FIGS. 1 and 2, the stop member 5 is comprised of two elements 17 and 18, of which one is a stop ring 17, which, by means of a clamping screw 22 is connected to the sleeve 3.1 for joint rotation therewith, while the other ring is a stationary stop 18 which is rigidly connected to the housing by a pin 19. The stop ring 17 is provided with a pin 21 extended laterally outwardly therefrom; pin 21 comes into contact with stop 18 in the null position. The stop ring 17 has a radial slot as shown in FIG. 2 and is connected by the clamping screw 22 to the sleeve 3.1 for joint rotation as mentioned above.

The mode of operation of stop member 5 having ring 17 and stop 18 in connection with the clamping ring 9, positioning ring 10 and clamping screw 11 of the adjustment device 3 is as follows:

The first adjustment of the doctor blade 1.3 is carried out so that in case of the smallest width "S" of the play between the doctor blade 1.3 and roller 16, the pin 21 secured to the stop ring 17, abuts against stationary stop 18. The measuring value receiver 13 in this position sends to the operator desk a signal "null" which is indicated on the operator desk. As roller 16 becomes worn off in the course of time it is necessary to newly adjust the width "S" of the play. For this new adjustment the stop member 5 with ring 17 and stop 18 is not utilized. The new adjustment of the width "S" is carried out only by untightening of the clamping screw 11 in the clamping ring 9 and positioning ring 10. The latter is connected to the screw 1.1 by pin 23 for joint rotation therewith as shown in FIG. 3, whereby the ink zone-adjusting screw 1.1 can move axially due to the thread provided at its front end. This axial motion is translated via the lever 1.2 to the doctor blade 1.3. Upon reaching of the predetermined play "S" the clamping screw 11 is again tightened. Since the sleeve 3.1 is not rotated during the above described new or additional adjustment the value receiver 13 is not rotated either so that the initial "null" position remains unchanged.

The connection between the sleeve 3.1 and the ink zone-adjusting screw 1.1 can be adjusted when screw 11 is tightened. When adjusting screw 11 is untightened the connection between sleeve 3.1 and screw 1.1 is released and, upon the rotation of the positioning ring 10 and the clamping ring 9, an axial displacement of the ink-zone-adjusting screw 1.1 relative to the sleeve 3.1 is carried out. The pitches of the threads of sleeve 3.1 and screw 1.1 are the same.

Clamping ring 9 is formed with a plane parallel slot. A threaded bore, in which the screw 11 is engaged, is provided at the right-hand side of that slot while a through bore for receiving screw 11 is provided at the left side of the slot. Upon tightening of the screw 11 the side of the clamping ring, having the threaded bore, is deformed in the direction of the positioning ring 10 whereby strain is exerted on the thread of sleeve 3.1 and a rotation-rigid connection is generated. A joint rotation of the positioning ring 10 and the clamping ring 9 is possible because when screw 11 is loosened and positioning ring 10 is rotated the rotation motion is translated to the clamping ring 9 by the screw 11. This is possible because screw 11 is not completely removed from rings 9 and 10 but is only partially unscrewed so as to reduce the clamping effect of the threads.

Due to a wear off of the front edge of the dosing member 1.3 the value of the gap width indicated by the receiver 13 and the indicator on the control desk would no longer correspond to actual structure conditions or data in the printing process because the width of the gap S would be by a worn-off value greater than the required one. In order to compensate for a wear-off value the zero position of the receiver 13 remains unchanged while the first adjustment is performed mechanically by means of the stop member 5 as described above. When the clamping screw 11 is released and the positioning ring 10 together with the clamping ring 9 are rotated on the thread of the sleeve 3.1 the latter is locked by stop member 5. It should be noted that during the assembling of this adjusting device a clearance or play "1" is provided between the positioning ring 10 and the end of the sleeve 3.1. This play "1" is provided for the additional adjustment movement of the ink zone adjusting screw 1.1.

Due to the rotational movement of the positioning ring 10 and the clamping ring 9, the ink zone adjusting screw 1.1 will be displaced relative to the sleeve 3.1 and thereby it will be adjusted to a mechanical path of ink gap S=O.

After this simple mechanical adjustment the actual values (electrical and mechanical null) are registered and the clamping screw 11 can be again tightened.

It is to be understood that the present invention is not limited to the exemplified embodiment but can be applied to divided dosing members or can be utilized for another means, for example for the arrangement of the pressure pin within the ink zone adjusting screw or within the adjustment translation member 1.

It will be understood that each of the elements described above, or two or more together, may also find a useful application in other types of ink dosage adjusting devices in printin g machines differing from the types described above.

While the invention has been illustrated and described as embodied in an ink dosage adjusting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. An ink dosage adjusting device in a printing machine for adjusting a position of a dosing doctor blade relative to a doctor roller to thereby adjust an ink gap therebetween, comprising a housing, at least one ink zone adjusting screw operatively connected to said dosing doctor blade to move the latter to and from said doctor roller; motor-driven driving means for driving said ink zone adjusting screw; a measure value receiver operatively connected to said screw for receiving an adjustment value; first adjusting means for adjusting the position of said screw and thus said ink gap without affecting an adjustment by said measure value receiver; and second adjusting means arranged on said ink zone adjusting screw for compensating for wear of said dosing doctor blade, said second adjusting means including a rotatable hollow sleeve through which said screw extends and to which said screw is connected, and a two-ring adjusting element positioned at an end of said sleeve excessible from outside of said housing.

2. The device as defined in claim 1, wherein said first adjusting means includes a stop member adjustably positioned on said sleeve within said housing.

3. The device as defined in claim 2, wherein said sleeve carries a pinion, said driving means including a gear which is in mesh with said pinion.

4. The device as defined in claim 3, wherein said receiver carries another gear which is in mesh with said pinion.

5. The device as defined in claim 4; said first adjusting means, said gears, said second adjusting means, said motor, said receiver and said stop member being positioned in said housing.

6. The device as defined in claim 2, wherein said two-ring element includes a positioning ring secured to said adjusting screw, and a clamping ring mounted on the end of said sleeve and releasably connected to said positioning ring.

* * * * *